United States Patent [19]

Viellard

[11] Patent Number: 4,954,198

[45] Date of Patent: Sep. 4, 1990

[54] METHOD OF FABRICATING GOLF CLUBS AND ASSEMBLY OF TUBES FOR FORMING CLUBS OBTAINED BY THE METHOD

[76] Inventor: Paul H. Viellard, 22 rue Spontini, F-75II6 Paris, France

[21] Appl. No.: 286,815

[22] Filed: Dec. 20, 1988

Related U.S. Application Data

[63] Continuation-in-part of Ser. No. 5,161, Feb. 2, 1987, abandoned.

[30] Foreign Application Priority Data

| | | | |
|---|---|---|---|
| Apr. 19, 1985 | [FR] | France | 85 05968 |
| May 2, 1985 | [FR] | France | 85 06638 |
| May 15, 1985 | [FR] | France | 85 07346 |
| Apr. 11, 1986 | [WO] | PCT Int'l Appl. | FR86/0019 |

[51] Int. Cl.[5] ..... B32B 27/04

[52] U.S. Cl. ..... 156/294; 156/189; 273/80 R; 273/80.2

[58] Field of Search ..... 273/80 R, 80.2, 81 R, 273/DIG. 7; 156/189-192, 293, 294

[56] References Cited

U.S. PATENT DOCUMENTS

| | | | |
|---|---|---|---|
| 1,535,719 | 4/1925 | Fisher | 273/81 R |
| 1,968,616 | 7/1934 | Oldham | 273/80 B X |
| 1,994,149 | 3/1935 | Root | 273/80.2 |
| 2,475,927 | 7/1949 | Verderber | 273/81.2 |
| 2,478,554 | 8/1949 | Yearly | 273/80.2 |
| 3,214,170 | 10/1965 | Warnock | 273/81.2 X |
| 3,313,541 | 4/1967 | Benkoczy et al. | 273/80 R |
| 3,539,185 | 11/1970 | Andis | 273/80 D X |
| 3,629,029 | 12/1971 | Holahan | 156/189 |
| 3,871,649 | 3/1975 | Kilshaw | 273/80 B X |
| 3,873,090 | 3/1975 | Thompson | 273/80.5 X |
| 4,023,801 | 5/1977 | VanAuken | 273/80 B |
| 4,097,626 | 6/1978 | Tennent | 273/80 R X |
| 4,240,631 | 12/1980 | MacDougall | 273/77 A |
| 4,259,382 | 3/1981 | Schwan | 156/189 X |
| 4,555,112 | 1/1985 | Masghati | 273/80 R X |
| 4,563,007 | 1/1986 | Bayliss et al. | 273/77 A |

*Primary Examiner*—David Simmons

*Attorney, Agent, or Firm*—William A. Drucker

[57] ABSTRACT

A method of producing golf clubs and having the same, or regularly increasing or decreasing flexibility which consists in manufacturing each shaft of the clubs from several different tubes, one tube possibly tapering in its central part and made from metal or synthetic fibers such as carbon fibers, boron fibers, glass fibers or aromatic polyamid fibers which is inserted into two other tubes, preferably of metal, one forming the support for the head of the club and the other the handle over lengths respectively such that the frequency of vibration of the club, which depends on its flexibility, over a length equal to its size less a distance d from the top of the handle, is controlled.

7 Claims, 1 Drawing Sheet

METHOD OF FABRICATING GOLF CLUBS AND ASSEMBLY OF TUBES FOR FORMING CLUBS OBTAINED BY THE METHOD

This is a continuation-in-part application of my copending application Ser. No. 005,161 filed Feb. 2, 1987, now abandoned.

BACKGROUND OF THE INVENTION

Golf is a sport which requires a choice of equipment of a quite special complexity. A professional champion, in order to strike a ball only 70 times over an 18 hole course, may use 15 different clubs whose characteristics will be adapted to each strike, these characteristics comprising the length of the shaft, the weight of the club and the shape of the head as well as its opening angle (called loft angle). The characteristics of the club will be selected here which depend essentially on the requirements of the players, that is to say, the length and flexibility of the shaft as well as the total weight of the club. These three essential parameters lead to "standardized" definitions, commonly admitted by all golfers and characterizing the "series" of clubs. By series of clubs is meant an assembly of about 12 clubs or so, more particularly 8 irons and 3 woods or 9 irons and 6 woods belonging all at one and the same time to one of the five classes of elasticity defined in accordance with the "Kenneth Smith" scale and designated respectively by L (ladies), A (flexible), R (medium), S (stiff), E (extra stiff) as well as to one or the other of the two classes of shaft lengths (men or women). It is noted here that there is no precise scientific definition of these classes of elasticity: where does medium stop to become a stiff?

It should be recalled that each of the 15 clubs of a series of 9 irons and 6 woods has a head which strikes the ball at a different angle (loft angle) allowing it to impart a more or less flat and more or less stabilized path depending on the spin given to the ball so as to take into account distances and obstacles which must be crossed. This loft angle is modified by the elasticity of the shaft. Thus, if a golf club manufacturer wishes to offer a fairly complete range of clubs, he must manufacture so as to take into account the five degrees of elasticity and the two degrees of length (men, women) which is ten series (5×2). The clubs of the same series have different characteristics but these characteristics have a certain homogeneity concerning particularly the characteristic which forms the "swing weight" which must remain substantially constant for the clubs of the same series. This "swing weight", a sort of moment of the striking force exerted on the ball, is calculated by multiplying the total weight of the club by the length of the distance which separates the center of gravity of the club from the theoretical point situated conventionally at 12 inches, that is to say 30.5 cm from the top of the shaft of the club (official scale swing-weight) or 15 inches (35.5 cm) from the top of the shaft (lorythmic swing weight). It is complex to take into account all the characteristic parameters of the clubs so as to manufacture a series of homogeneous clubs desired by the player (that is to say, a series of so called "consistent" clubs).

It is noted that it is also advantageous to lighten the shaft of a golf club. In fact, the energy E recovered by the ball at the end of the "swing" will be greater, that is to say, the ball will go farther, when the shaft is lighter. The energy given to the ball is such that $E=\frac{1}{2}MV^2$, M being the mass of the club and V the speed of the swing.

It can be seen that for the same force, if the mass is low and the speed increases, the energy transmitted to the ball is in a proportion which increases with the square of this speed. It may then appear interesting to use light materials such as carbon fibers for manufacturing the golf clubs. However synthetic fiber shafts have other defects which have not up to present been easily overcome, in particular it is very difficult to obtain a series of "consistent" carbon fiber clubs as mentioned above.

It may observed that the physical characteristic which will take better into account all of the variables (weight, length, elasticity) is the frequency of vibration of the club for it integrates all of these parameters.

For a series of clubs to be homogeneous ("consistent") the vibration frequency of the clubs of the series must be constant or, if the player so desires, it must vary regularly from one club of the series to another.

SUMMARY OF THE INVENTION

The present invention provides a method of producing golf clubs all having the same flexibility, or having regularly increasing or decreasing flexibility.

The method of the invention allows control of the vibration frequency and the swing weight of golf clubs fabricated from the same metal materials or composite materials with carbon fibers associated with boron, aramide or glass fibers, produced in industrial scale production. According to the invention, the clubs are fabricated from tubes made from these materials then inserted into each other so that a control of the vibrational frequency is obtained and a very great resistance to tearing away. It is in fact known that the vibration phenomena inside tubes made from composite materials inserted together then crimped or bonded are modified.

The equation must be written here which simply expresses, under conditions doubtless approximative but satisfactory, and this frequency "f" of vibration may be written:

$$f = \frac{1}{2\pi}\sqrt{\frac{3E\pi/4(R^4 - r^4)}{(M + 0.24\,m)\,L^3}}$$

in which

E designates the modulus of elasticity of the material forming the shaft (Young's modulus), R and r the external and internal radii of the hollow shaft, that is to say the thickness of the wall, M the mass of the head of the club and m the mass of the shaft L designates the length of the club.

It can be observed that for varying the vibration frequency of a club it is impossible to adjust all the parameters for the mass M and length L are imposed by the standards. Thus, if it is desired for example that the nine iron clubs of a same series have the same vibration frequency f when themasses M1, M2, M3 . . . of the heads and the lengths L1, L2, L3 . . . of the clubs are imposed, essentially only the parameters of the numerator of the above mentioned equation can then be adjusted. Consequently only the elasticity of the shaft can be adjusted, and also possibly the length l along which the tube walls are superimposed, while the thickness of the shaft (R-r) remains constant.

The essential characteristic of the invention takes into account what has just been said above for it consists in varying "according to the demand" the elasticity of the shafts of the clubs by inserting on to given lengths l a central whip in one or more of the end tubes.

Thus, the superimposition of crimped materials, on lengths l which may be chosen at will, of different modulii of elasticity allow the flexibility of the club to be varied also at will. Hence the equation of the frequency of vibration of the club may be written:

$$f = \frac{1}{2\pi} \sqrt{\frac{3Ef(1)\frac{\pi}{4}(R^4 - r^4)}{(M + 0.24\,m)\,L^3}}$$

This search for "frequency matching" is known in the golf club field. Authors and manufacturers have tackled this problem and have taken out patents.

Thus, the U.S. Pat. No. 3 871 649 to Kilshaw presents a method of adjusting the frequency by varying either the lengths of the ends of the metal clubs which have different diameters or the thickness of the metal wall but cannot be found the superposition of two walls of different modules which is presented according to the invention.

The U.S. Pat. No. 4 122 593 describes a table for calculating the amunt of material to be used at one or other of the ends of a metal club for frequency matching within a narrow range.

The British patent 2 146 906 (Wilson Sporting Goods) describes a method of matching vibrational frequencies by varying, during manufacture by drawing then hammering the metal tube, the length of an intermediate step, then by removing material at one end.

The U.S. Pat. No. 3 539 185 to Andis concerns a golf club having an adjustable length shaft but it is impossible to obtain the same vibration frequency for different lengths of the club, especially since it is definitely forbidden by the U.S. Golf Association (USGA) rules to use golf clubs having an adjustable length in USGA sponsored events.

The U.S. patent to MacDougall (4 240 631) has for its object to provide matched set of golf clubs through the use of a common master shaft. According to this patent, the vibration frequency of the club may be varied while the club length is kept constant by cutting one or the other end (of different diameters) of the club. That is wholly different from the method of the present invention where the vibration frequency can be kept constant while the shaft length is modified by varying the length along which two or more tubes forming the golf club are inserted in each other.

The U.S. Pat. No. 1 968 618 to Oldham concerns a golf club having telescoping adjacent end portions but it is clear tht it would be impossible to cover all the range of elasticity as the conical shape of each element would have to be changed each time.

It is clear that a combination of the cited patents to Andis, MacDougall, Oldham, Kilshaw would lead to variation at the L, R and r parameters and not to operation on the modulus E parameters as in the present invention.

BRIEF DESCRIPTION OF THE DRAWINGS

The invention embodiments will be described hereafter without any limitative character with reference to the acompanying drawings in which.

DESCRIPTION OF THE PREFERRED EMBODIMENT

Figure 1:
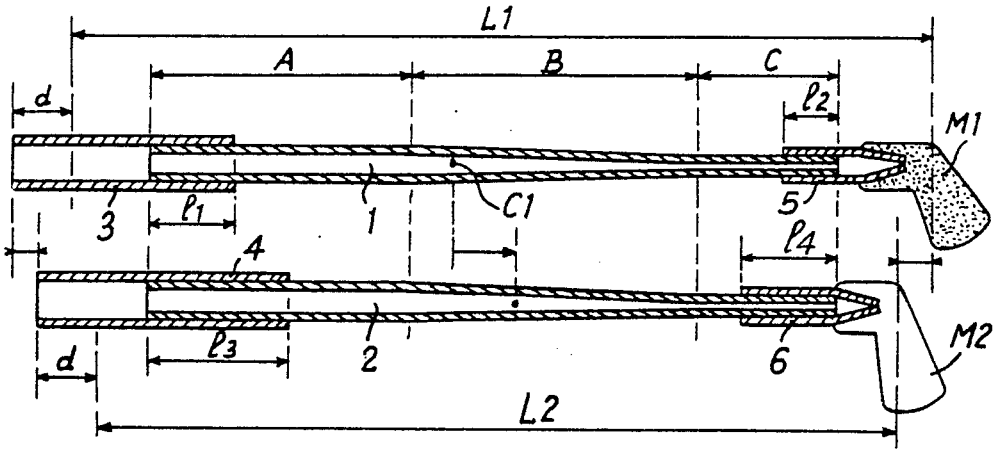
FIG. 1 shows a schematic drawing of two clubs having different heads M1 and M2 but identical whips (or central parts) (1) and (2) inserted together at the level of the heads and on the handles in tubes over different lengths "l". These lengths extend on the cylindrical parts made on the two extremities of the whip.

In the example shown in FIG. 1, the two clubs are formed by two tubes 1 and 2 made from carbon fibers bonded by means of epoxy resins, for example. These tubes are absolutely identical not only in composition but in their metrological characteristics, so that they may be manufactured in series. Tapered in their middle part (B), these tubes are cylindrical at their extremities (A) and (C), which is an essential characteristic.

According to a characteristic of the method of fabricating clubs of the invention, the tubes are inserted along their cylindrical parts, then bonded or crimped over lengths $l_1$, $l_2$, $l_3$ and $l_4$ inside metal tubes 3, 4, 5 and 6 intended to form the handles and to bear the heads $M_1$ and $M_2$. The lenghts $l_1$, $l_2$, $l_3$ and $l_4$ of introduction of tubes 3, 5, 4 and 6 are chosen so that the vibratory frequency of the whips $L_1$ and $L_2$, which extend from the head to a point situated at a distance "d" from the extremity of the handles while supporting the head loads $M_1$ and $M_2$, is the same. The distance "d" on the handle is firmly clamped so that only the distances $L_1$ and $L_2$ may vibrate, the vibrations being observed through a simple electronic device associated with an oscilloscope.

Hence, and for example, if these two clubs have to be "stiff", according to the standards, their frequency f must be 280 cycles per minute (CPM). As they have to be of same elasticity, the lengths $l_1$, $l_2$, $l_3$ and $l_4$ are found through forms (A) and (B):

$$280 = \underbrace{\frac{1}{2\pi} \sqrt{\frac{3Ef(l_1, l_2)\frac{\pi}{4}(R^4 - r^4)}{(M_1 + 0.24\,m_1)\,L_1^3}}}_{(A)} = \underbrace{\frac{1}{2\pi} \sqrt{\frac{3Ef(l_3, l_4)\frac{\pi}{4}(R^4 - r^4)}{(M_2 + 0.24\,m_2)\,L_2^3}}}_{(B)}$$

According to this device, it will be understood that a series of homogenous clubs may be readily manufactured while remaining inside the limits imposed by standards and international habits. A constant swing weight may also be kept for it can be observed that as the mass $M_1$ increases to $M_2$ progressively in weight, the inserted length $l_1$ increases towards $l_3$ and the movement of the center of gravity $C_1$ does not take place solely towards mass $M_1$ in accordance with the increase of this mass.

If the swing weight cannot be kept constant, a small mass may be added at the level of the handle whose influence will not be exerted on the vibratory frequency but which will tend, on the contrary, to move the center of gravity away from the head $M_1$.

Figure 2:
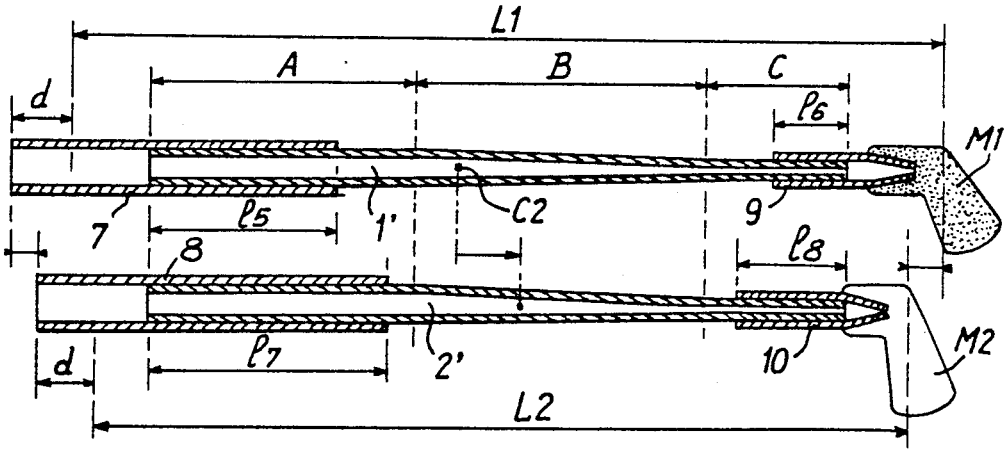
FIG. 2 shows two club whose identical whips (1) and (2) are inserted at the level of the heads and of the handles in tubes over different lengths "l" also different from the lengths "l" of FIG. 1.

In the example of FIG. 2, the two clubs are formed by two tubes 1' and 2' made from synthetic fibers, carbon fibers for example bonded by epoxy resins. These two tubes are absolutely identical to tubes 1 and 2 of FIG. 1.

Head loads $M_1$ and $M_2$ are the same as in Figure as are lengths $L_1$ and $L_2$. However lengths $l_5$, $l_6$, $l_7$, $l_8$ are different and respectfully longer than $l_1$, $l_2$, $l_3$, $l_4$.

Tubes 7, 8, 9 and 10 are of same material and thickness as tubes 3, 4, 5 and 6.

These two clubs of FIG. 2 are stiffer than the two preceding clubs of FIG. 1 although they are manufactured from a same "whip", because the values of the numerators of forms (A) and (B) become higher than in the case of FIG. 1.

It will be understood that the frequency of vibration can also be adjusted by sliding on the central part (1) only one tube, either the tube, (3) forming the handle or vice versa the tube (5) bearing the head. This new embodiment allows manufacturing the clubs from only two tubes, the central tube (1) and either the handle tube 3 or the tube 5 bearing the head.

It will finally be readily understood that the tubes 1 and 2 or 1' and 2' could be made from metal thus giving another variant of the device.

It will also be noted that the device of the invention overcomes a disadvantage which retards the use of synthetic fibers (however with very interesting characteristics) in the manufacture of golf clubs: since the heads must sometimes be changed, they are preferably bonded with thermofusible adhesives. Presently the heads cannot be secured to shafts made from resin bonded fibers by means of such thermofusible adhesives since these shafts do not withstand the heat well. However, according to the present invention the metal tubes 5, 6, 9, 10, intended to co-act with the heads M1, M2, are heat resistant and consequently allow thermofusible bonding in spite of the fact that the shaft is partially made from synthetic fibers.

It will also be noted that the device of the invention allows a substantial saving of costly materials to be made since the part of the shafts at the level of the club handle is formed especially by substantially less expensive metal than synthetic fibers.

What is claimed is:

1. A method of producing a set of golf clubs, all having the same flexibility, in order to obtain a frequency matching, comprising the steps of:

(a) forming the shaft of each club from three different tubes including an intermediate tube having cylindrical ends made from synthetic fibers, (b) fitting the ends of said intermediate tube in the other two tubes, from which one other tube forms a support for the head of the club and the second other tube forms a handle, (c) varying the amount of overlap of the tubes which are fitted together to hold the vibration frequency of the club constant for said set of golf clubs, (d) bonding said tubes together in the area of said overlap, and (e) varying the vibration frequency from a first set of clubs to another set of clubs dependent on the desired flexibility required by the player.

2. The method of claim 1 wherein said synthetic fibers are taken from the class consisting of carbon fibers, boron fibers, glass fibers and aromatic polyamides fibers.

3. A method of producing a set of golf clubs, all having the same flexibility, in order to obtain a frequency matching, comprising the steps of:

(a) forming the shaft of each club from at least two different tubes, one said tube forming the handle of the shaft and another tube made from synthetic fibers supporting the head of the club and being cylindrical at its end on the handle side, (b) fitting the cylindrical end of said another tube into said one tube, (c) varying the amount of overlap of the tubes which are fitted together to hold the vibration frequency of the club constant for said set of golf clubs, (d) bonding said tubes together in the area of said overlap, and (e) varying the vibration frequency from a first set of clubs to another set of clubs dependent on the desired flexibility required by the player.

4. The method of claim 3 wherein said synthetic fibers are taken from the class consisting of carbon fibers, boron fibers, glass fibers and aromatic polyamide fibers.

5. A method of producing a set of golf clubs, all having the same flexibility, in order to obtain a frequency matching, comprising the steps of:

(a) forming the shaft of each club from at least two different tubes, one said tube made from metal and carrying the head of the club and another said tube made from synthetic fibers and being cylindrical at its end on the head side, (b) fitting the cylindrical end of said another tube into said metal tube carrying the head, (c) varying the amount of overlap of the tubes which are fitted together to hold the vibration frequency of the club constant for said set of gold clubs, (d) bonding said tubes together in the area of said overlap, and (e) varying the vibration frequency from a first set of clubs to another set of clubs dependent on the desired flexibility required by the players.

6. The method of claim 5 wherein said synthetic fibers are taken from the class consisting of carbon fibers, boron fibers, glass fibers and aromatic polyamide fibers.

7. A method of producing a set of golf clubs, all having the same flexibility, in order to obtain a frequency matching, comprising the steps of:

(a) forming the shaft of each club from three different tubes including an intermediate tube having cylindrical ends and made from metal, (b) fitting the ends of said intermediate metal tube in the other two tubes, from which one other tube forms a support for the head of the club and the second other tube forms a handle, (c) varying the amount of overlap of the tubes which are fitted together to hold the vibration frequency of the club constant for said set of golf clubs, (d) bonding said tubes together in the area of said overlap, and (e) varying the vibration frequency from a first set of clubs to another set of clubs dependent on the desired flexibility required by the player.

* * * * *